US006768073B1

(12) United States Patent
Tondra et al.

(10) Patent No.: US 6,768,073 B1
(45) Date of Patent: Jul. 27, 2004

(54) PIVOTING HANDLE AND CONTROL ARRANGEMENT FOR A FLOOR CARE APPLIANCE

(75) Inventors: Aaron P. Tondra, North Canton, OH (US); Mark J. Josef, Mogadore, OH (US); Jackson W. Wegelin, Akron, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 10/613,406

(22) Filed: Jul. 3, 2003

(51) Int. Cl.[7] ..... H01H 9/06
(52) U.S. Cl. ..... 200/332.2; 200/331
(58) Field of Search ..... 15/319, 325, 332, 15/339, 389, 410; 200/17 R, 43.04, 43.07, 50.06, 61.85, 61.86, 329–331, 332.1, 332.2

(56) References Cited

U.S. PATENT DOCUMENTS 4,051,340 A * 9/1977 Wolski ..... 200/329
4,421,964 A 12/1983 Buchtel
4,810,855 A * 3/1989 Dassi et al. ..... 219/474
4,845,803 A * 7/1989 King ..... 15/339
4,954,668 A * 9/1990 Sako ..... 200/314
5,226,527 A * 7/1993 Maurer et al. ..... 200/331

FOREIGN PATENT DOCUMENTS

JP 2003135346 A 1/2001 ..... A47L/9/32

* cited by examiner

*Primary Examiner*—Michael A. Friedhofer
(74) *Attorney, Agent, or Firm*—A. Burgess Lowe; Michael J. Corrigan

(57) ABSTRACT

A pivoting handle and control arrangement is provided for a floor care appliance such as a vacuum cleaner. An actuator rod in the handle is utilized for remotely triggering a switch located in the lower part of the housing. The switch could be utilized for controlling a feature of the floor care appliance such as a surge control for a vacuum cleaner's suction motor. A trigger positioned on the handle is operatively connected to an actuator rod traversing the interior of the handle. The distal end of the actuator rod is in operative engagement with the switch when the handle is in the upright position. When the trigger is depressed, the actuator rod depresses the switch causing it to close. The feature controlled is thereby energized. When the handle is moved to the folded position, the actuator rod is folded with the handle and moved away from the switch.

15 Claims, 4 Drawing Sheets

PIVOTING HANDLE AND CONTROL ARRANGEMENT FOR A FLOOR CARE APPLIANCE

FIELD OF THE INVENTION

Generally, the invention relates to controls. Particularly, the invention relates to a pivoting handle and control arrangement for a floor care appliance such as a vacuum cleaner.

BACKGROUND OF THE INVENTION

The use of pivoting handles in floor care appliances such as upright vacuum cleaners is old and well known in the art. An example of such an arrangement can be found in Japanese Publication No. 06245889. However, no provision is made in such a pivoting handle arrangement for remotely triggering a switch or other device located in the lower part of the housing. Such a switch could be utilized for controlling a feature of the floor care appliance such as a surge control for a vacuum cleaner's suction motor. The instant invention is a trigger or button positioned on the handle operatively connected to an actuator rod traversing the interior of the handle. The distal end of the actuator rod is normally in operative engagement with a switch in the lower housing when the handle is in the upright position. When the trigger is depressed, the actuator rod depresses the switch causing it to close thereby energizing an associated feature. When the handle is moved to the folded position, the actuator rod is folded with the handle and moved away from the switch. These and other objectives will be readily apparent from the following description taken in conjunction with the accompanying drawings.

SUMMARY OF THE INVENTION

In carrying out the invention in one aspect thereof, these objectives and advantages are obtained by providing a machine including a floor care appliance having a pivoting handle and control arrangement. In the preferred embodiment of the present invention, an actuator rod in the handle is utilized for remotely triggering a switch located in the lower part of the housing. The switch could be utilized for controlling a feature of the floor care appliance such as a surge control for a vacuum cleaner's suction motor. A button or trigger positioned on the handle is operatively connected to an actuator rod traversing the interior of the handle. The distal end of the actuator rod is in operative engagement with the switch when the handle is in the upright position. When the button or trigger is depressed, the actuator rod depresses the switch causing it to close. The feature controlled is thereby energized. When released, the switch is opened. When the handle is moved to the folded position, the actuator rod is folded with the handle and moved away from the switch.

BRIEF DESCRIPTION OF DRAWINGS

Embodiments of the invention, illustrative of several modes in which applicants have contemplated applying the principles are set forth by way of example in the following description and are shown in the drawings and are particularly and distinctly pointed out and set forth in the appended claims.

DESCRIPTION OF THE PREFERRED EMBODIMENT

Figure 1:
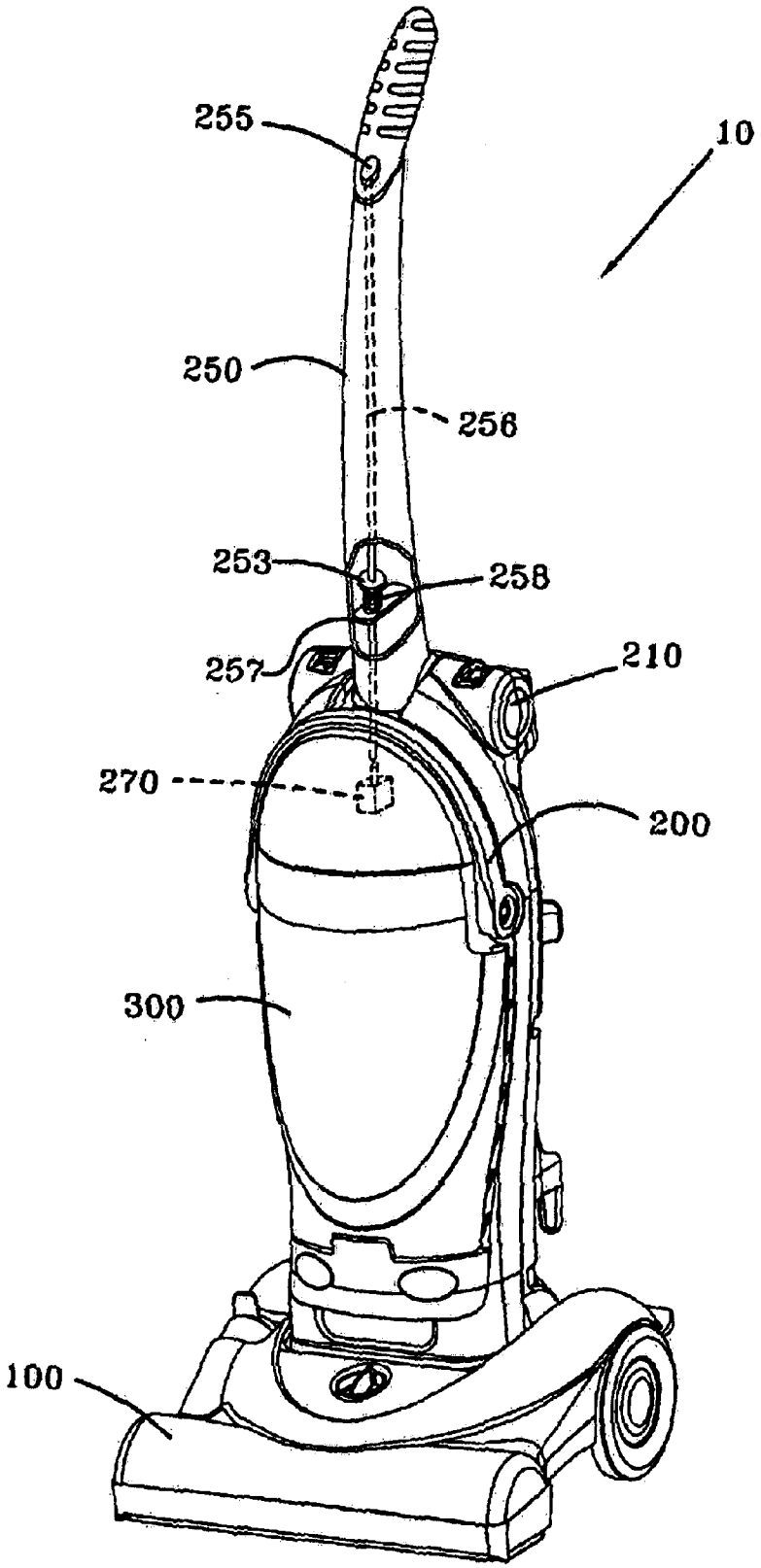
FIG. 1 is a perspective view of a vacuum cleaner which includes the present invention.

A vacuum cleaner incorporating the present is shown in FIG. 1 and is indicated generally at 10, according to the preferred embodiment of the present invention. Vacuum cleaner 10 includes a vacuum cleaner foot 100 and a vacuum cleaner housing 200 connected to the vacuum cleaner foot 100. The foot 100 is formed with a bottom nozzle opening (not shown) which opens towards a floor surface. A handle 255 is pivotally connected to a housing 200 by a hinge assembly 210. In the preferred embodiment, the vacuum cleaner is similar to the indirect air bagless vacuum cleaner disclosed in Hoover Case 2649, U.S. patent application Ser. No. 10/417,866 owned by a common assignee and incorporated by reference fully herein. In an alternate embodiment of the invention, the vacuum cleaner may be a direct air vacuum cleaner or any other type of floor care appliance utilizing suction. The vacuum cleaner 100 is of the type having an agitator (not shown) and positioned within an agitator chamber (not shown) formed in an agitator housing which is part of foot 100. The agitator chamber, (not shown) communicates with the nozzle opening (not shown) and the agitator (not shown) rotates about a horizontal axis inside the agitator chamber (not shown) for loosening dirt from the floor surface. The loosened dirt is drawn into a suction duct located behind and fluidly connected to agitator chamber (not shown) by a suction airstream generated by a motor-fan assembly (not shown). The suction duct (not shown) directs the loosened dirt to a dirt particle filtration and collecting system positioned in housing 200.

In the preferred embodiment of the invention, a button or trigger 255 is located at the upper end of a handle portion 250. Trigger 255 is connected to an actuator rod 256 traversing the interior of handle 250. When handle 250 is in the upright position, as shown in FIG. 1, the lower end 259 (FIG. 2) is proximate to the plunger on a control device 270 located in housing 200. In the preferred embodiment of the invention, control device 270 is an electrical switch used to control a surge feature of a suction motor (not shown).

Figure 2:
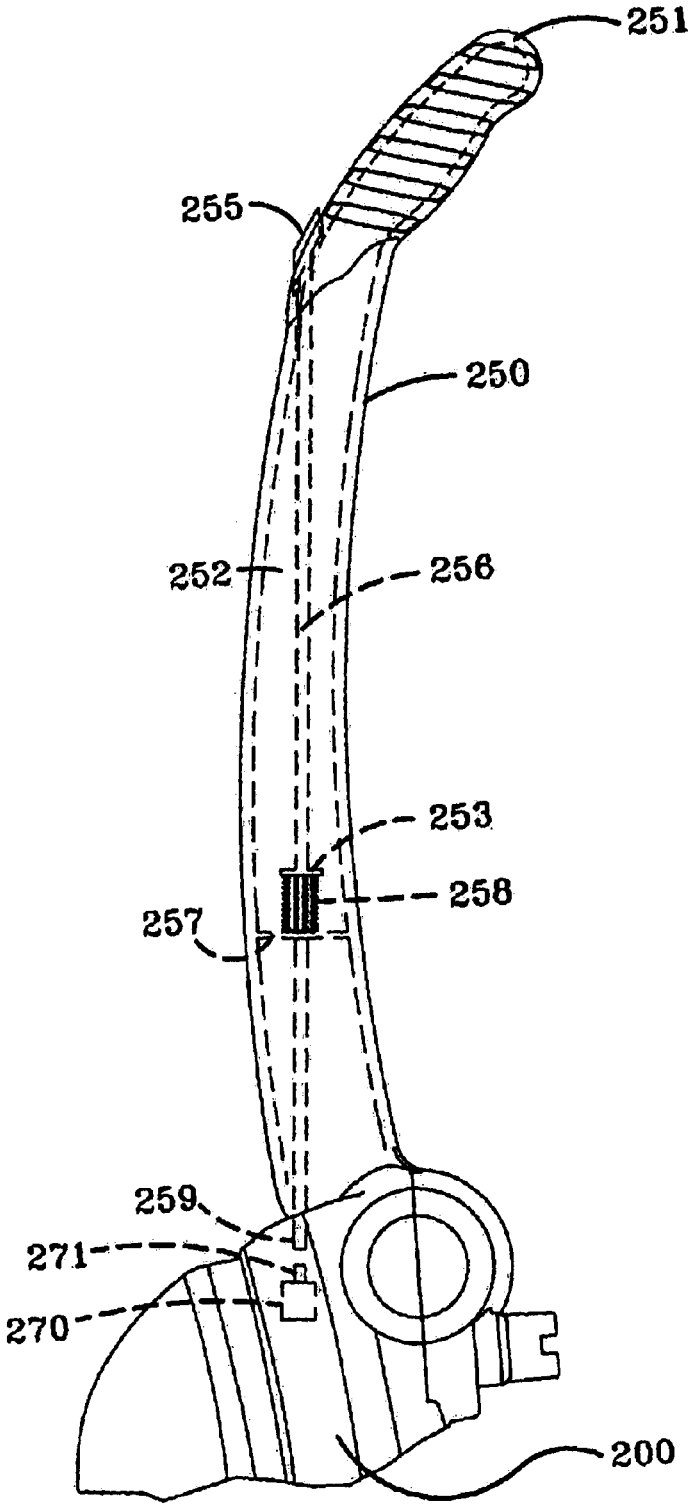
FIG. 2 is the vacuum cleaner of FIG. 1 with a partial cutaway portion of the housing and a partial cutaway view of the handle in the upright position.

Referring now to FIG. 2, more detail of the actuator rod 256 traversing the interior 252 of handle 250 is shown. At the upper end of handle 250 is a hand grip 251 and trigger 255. Trigger 255 is directly connected to actuator rod 256. Located on the lower portion of actuator rod 256 is a stop 253 for biasing actuator rod 256 upward against a lip or ridge 257 formed in the interior of handle 250. A spring 258 is located there between which biases actuator rod 256 in the upward direction. When handle 250 is in the upright position, as shown in FIG. 2, the lower end 259 of actuator rod 256 is in the proximate area of control device 270 but not engaging plunger 271 of control device 270. When trigger 255 is depressed, as when it is desired to activate a feature such as a surge of the suction motor (not shown), the lower end 259 of actuator rod 256 forces plunger 271 of control device 270 downward and the feature is activated. In the preferred embodiment of the invention, control device 270 is an electrical switch which is closed when trigger 255 is depressed. When trigger 255 is released, actuator rod is forced upward by spring 258 and the lower end 259 of actuator rod 256 releases plunger 271 of control device 270 and the feature is deactivated. In an alternate embodiment of the invention, the lower end 259 of actuator rod 256 protrudes through the outer ring of the trunnion connecting the handle 250 to the lower housing 200. The control device 270 is also embedded in the outer ring of the trunnion but in the lower half such that when the handle is in the upright position the lower end of the actuator rod is in the proximal area of the plunger of the control device. This allows actuator rod 256 to engage plunger 271 when trigger 255 is depressed. This allows all components of the arrangement to be enclosed within the handle 250 and the trunnion. The arrangement also allows the handle 250 to be folded into the folded position while removing the lower end 259 of the actuator rod 256 from the proximal area of the plunger 271 of the control device 270.

Figure 3:
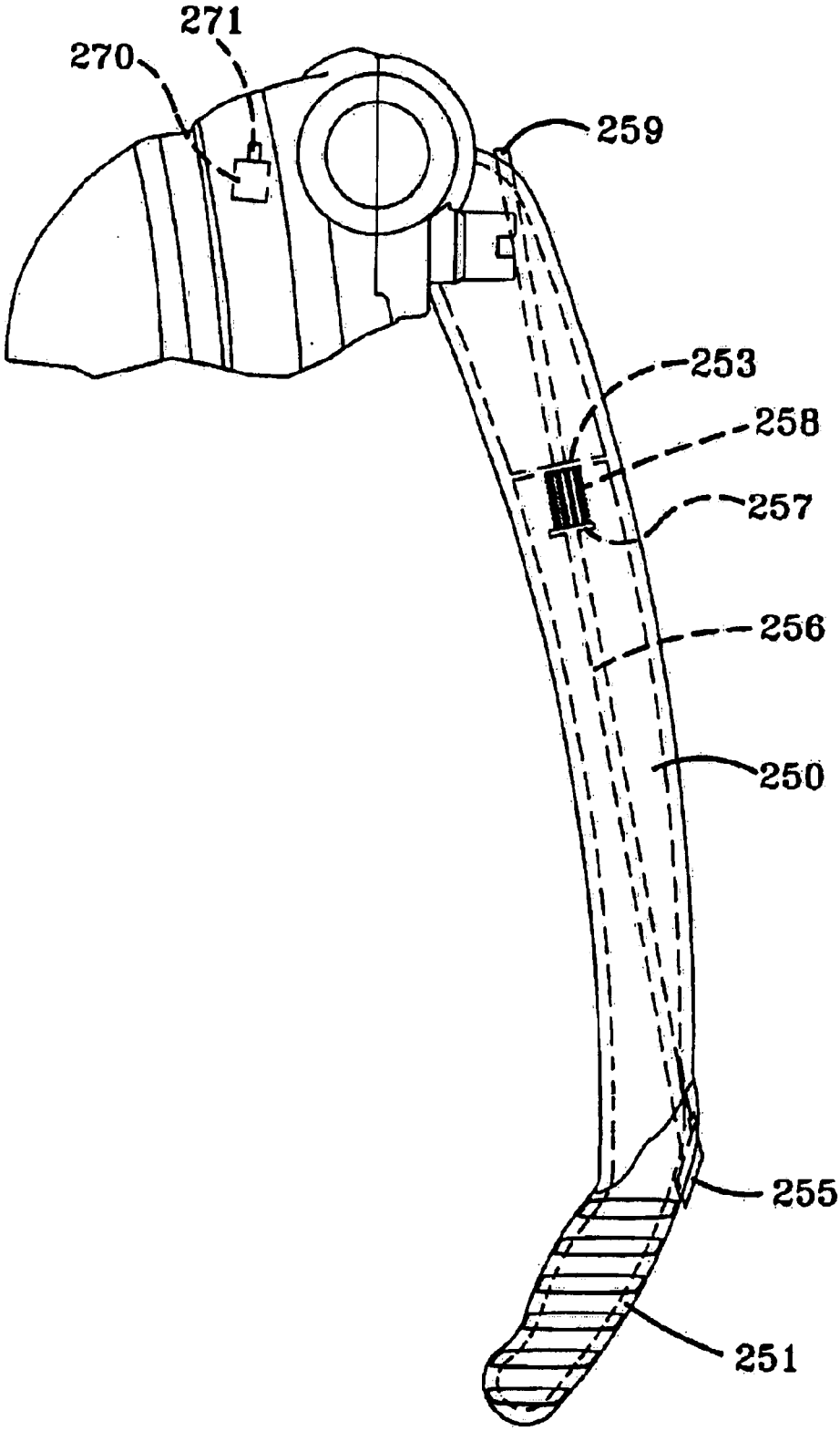
FIG. 3 is the vacuum cleaner of FIG. 1 with a partial cutaway portion of the housing and a partial cutaway view of the handle in the folded position.

Referring now to FIG. 3, handle 250 is shown in the folded position. It is desirable to fold handle 255 in certain instances such as for transport and storage. When handle 255 is in the folded position, the lower end 259 of actuator rod 256 is removed from the proximate area of control device 270 such that plunger 271 cannot be depressed.

Figure 4:
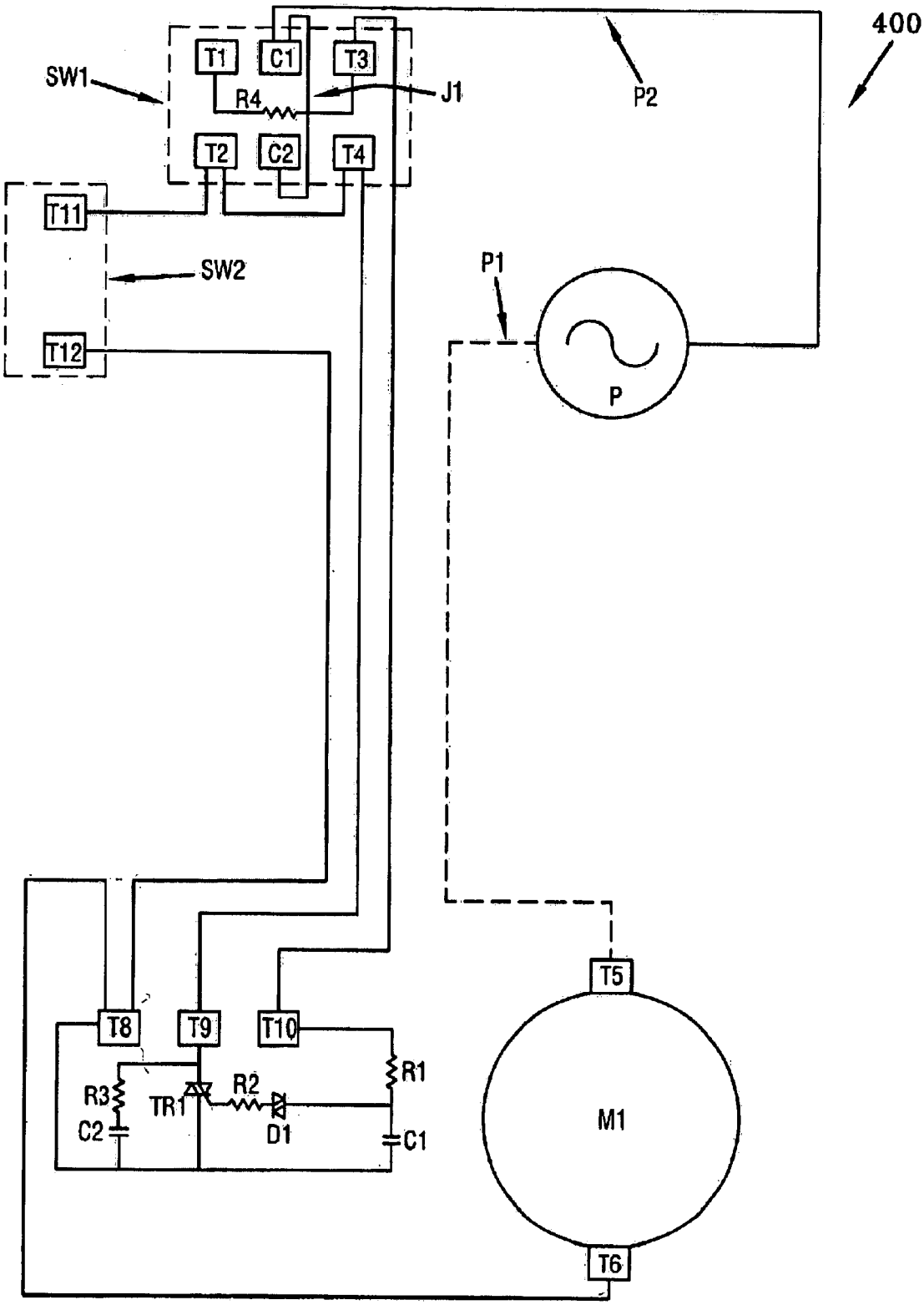
FIG. 4 is an electrical schematic of the multi-speed power and control circuit for the suction motor for a vacuum cleaner incorporating a switch for surging the suction motor, according to the preferred embodiment of the present invention.

Referring now to FIG. 4, shown is an electrical schematic of the multi-speed power and control circuit 400 for the suction motor Ml for a vacuum cleaner incorporating a switch for surging the suction motor M1. The circuit 400 is connected to a conventional 120 vac 60 Hz power source wherein the positive side P2 of the current source P is connected to a terminal C1 of a DPDT switch SW1 and the neutral side P1 is connected to a terminal T5 on the neutral side of the suction motor M1. The DPDT switch SW1 has a center off position, a low speed position, and a high speed position. The control circuit 400 controls the speed of the suction motor M1 by controlling the average voltage applied to the suction motor M1 based upon the switch setting. The average voltage applied to the suction motor M1 is controlled by turning on the current to the suction motor M1 for a discrete amount of time during both the positive and negative portions of the ac cycle. The discrete amount of time the current is turned on during the positive and negative portions of the ac cycle is determined by the position of the switch SW1, a resistor R4 and an R-C network described more fully hereinbelow.

In the high speed position, switch SW1 connects P2 to T10 through T3 to turn the current on to the suction motor M1. T10 is connected to a resistor R1 which is connected to a capacitor C1 and a diac D1. During the positive portion of the ac cycle, current will not flow through diac D1 until the voltage applied to it exceeds 30 volts. The time necessary to charge C1 creates a time delay from the time switch SW1 is moved from the off position to the high speed position before current begins to flow through diac D1. The output side of diac D1 is connected to the trigger side of a triac TR1 which controls the flow of current from the current source to the suction motor M1. Resistor R1 reduces the voltage applied to C1 and diac D1 otherwise capacitor C1 would charge too quickly and there would only be a negligible time delay before diac D1 opens and triac TR1 turns the current on to suction motor M1. The current flows from P2 via C1 to C2 via a jumper J1 which makes contact with T4. T4 is connected to T9 on one side of triac TR1. Once closed, triac TR1 allows current to flow to T8 which is connected to T6 on suction motor M1. A resistor R3 and capacitor C2 are placed in parallel with triac TR1 to smooth any fluctuations in the operation of triac TR1. The capacitor C1 follows the sine wave once the voltage across it reaches 30 volts and 30 volts are applied to diac D1 causing it to conduct. The built in delay in the current flowing through diac D1 because of resistor R1 and capacitor C1 causes triac TR1 to turn the current on to the suction motor M1 for only a portion of the ac cycle thereby reducing the average voltage applied to suction motor M1. The current to the suction motor M1 remains on until the voltage applied to the trigger side of triac TR1 again reaches 0 volts. This occurs when positive portion of the ac cycle hits the zero voltage threshold. In the preferred embodiment of the invention, R1=18 k ohm, R2 =10 ohms, R3 =3.3 k ohms, R4 =12 k ohms, C1 =0.33 micro farads, C2 =0.1 microfarads, D1 is a HT-32A diac, and TR1 is a BTA16-600BW triac.

During the negative portion of the ac cycle, current will not flow through diac D1 until the voltage applied to it falls below−30 volts. Due to the direction of the current being reversed, the poles of capacitor C1 are charged oppositely than during the positive portion of the ac cycle. Like during the positive portion of the ac cycle, the time necessary to charge C1 creates a time delay from the time switch SW1 is moved from the off position to the high speed position before current begins to flow through diac D1. Once the voltage across capacitor C1 reaches−30 volts, current is free to flow through diac D1 and a−30 volts is applied to the trigger side of triac TR1. Upon the application of the−30 volts to its trigger side, TR1 will turn the current on to the suction motor M1 and the trigger side follows the original sine wave. The current will remain on until the trigger side again reaches 0 volts. The built in delay in the current flowing through diac D1 because of resistor R1 and capacitor C1 causes triac TR1 to turn the current on to the suction motor M1 for only a portion of the ac cycle thereby reducing the average voltage applied to suction motor M1. The current flows from P2 via C1 to C2 via a jumper J1 which makes contact with T4. T4 is connected to T9 on one side of triac TR1. Once closed, triac TR1 allows current to flow to T8 which is connected to T6 on suction motor M1. The current to the suction motor M1 remains on until the voltage applied to the trigger side of triac TR1 reaches 0 volts. This occurs when negative portion of the ac cycle hits the zero voltage threshold.

When switch SW1 is in the low speed position, the circuit works similarly except that P2 is connected via C1 to T1. T1 is connected to T3 via a resistor R4 which creates a voltage drop before P2 is connected to T10. This increases the amount of time C1 requires to charge and creates a larger time delay before the voltage applied to diac D1 exceeds 30 volts during the positive portion of the ac cycle, and a larger time delay before the voltage applied to diac D1 reaches below−30 volts during the negative portion of the ac cycle. Of course, diac D1 will not conduct current until the voltage applied thereto is at or exceeds 30 volts or is at or falls below−30 volts and cause triac TR1 to turn the current on to the suction motor M1. Since TR1 turns the current on for shorter periods of time during each of the positive and negative portions of the ac cycle, the average voltage applied to the suction motor M1 is reduced resulting in a slower speed. The current flows from P2 via C1 to C2 via a jumper J1 which makes contact with T2. T2 is connected to T4 which is connected to T9 on one side of triac TR1. Once closed, triac TR1 allows current to flow to T8 which is connected to T6 on suction motor M1.

Additionally, the control circuit is equipped with a surge switch SW2 which essentially bypasses the entire R-C network and applies the full 120 vac current to sucton motor M1. Switch SW2 turns the current on to the suction motor M1 when dosed only when switch SW1 is in the high speed or low speed positions. When SW1 is in the high speed position, P2 is connected to C1 and C1 is connected to C2 via a jumper J1. C2 is connected to T4 which is connected to T2. T2 is connected to T11. T11 is connected to T12 when SW2 is closed. T12 is then connected to T8 which is connected to T6 on suction motor M1. Since energy follows the path of least resistance, and there is very little resistance from P2 to T8 when SW2 is closed, the current flows directly to the suction motor M1 bypassing flowing from T2 or T4 to T9. Similarly, when SW1 is in the low speed position, P2 is connected to C1 and C1 is connected to C2 via a jumper J1. C2 is connected to T2 which is connected to T11. T11 is connected to T12 when SW2 is closed. T12 is then connected to T8 which is connected to T6 on suction motor M1.

Accordingly, the pivoting handle and control arrangement for a vacuum cleaner is simplified, provides an effective, inexpensive, and efficient device which achieves all of the enumerated objectives. While there has been shown and described herein a single embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. A pivoting handle and control arrangement for a machine, a pivoting handle connected to a housing;

an actuator rod passing through the pivoting handle; and a control device located in the housing for controlling one or more features of the machine;

wherein said actuator rod is in operative engagement with said control device when said handle is in an upright position and said actuator rod is disengaged from said control device when said handle is in a folded position.

2. The pivoting handle and control arrangement for a machine of claim 1, wherein said actuator rod further includes a button on one end which is depressed to cause said actuator rod to engage said control device to control said one or more features of said machine.

3. The pivoting handle and control arrangement for a machine of claim 2, wherein one of said features is a suction-motor and said control device when engaged surges the suction-motor by applying full power to said suction-motor.

4. The pivoting handle and control arrangement for a machine of claim 2, further comprising a spring for biasing the actuator rod upward to disengage said actuator rod from said control device when said button is released.

5. The pivoting handle and control arrangement for a machine of claim 2, wherein said control device is a switch.

6. The pivoting handle and control arrangement for a machine of claim 5, wherein one of said features is a suction-motor and said switch when engaged surges the suction-motor by applying full power to said suction-motor.

7. The pivoting handle and control arrangement for a machine of claim 6, wherein said switch is part of a control circuit for controlling said one or more features including said suction motor.

8. A pivoting handle and control arrangement for a floor care appliance, a pivoting handle having an upper section and a lower section;

an actuator rod passing through the upper section; and a control device located in the lower section for controlling one or more features of the floor care appliance;

wherein said actuator rod is in operative engagement with said control device when said pivoting handle is in an upright position and said actuator rod is disengaged from said control device when said pivoting handle is in a folded position.

9. The pivoting handle and control arrangement for a floor care appliance of claim 8, wherein said actuator rod further includes a button on one end which is depressed to cause said actuator rod to engage said control device to control said one or more features of said floor care appliance.

10. The pivoting handle and control arrangement for a floor care appliance of claim 8, wherein one of said features is a suction-motor and said control device when engaged surges the suction-motor by applying full power to said suction-motor.

11. The pivoting handle and control arrangement for a floor care appliance of claim 8, further comprising a spring for biasing the actuator rod upward to disengage said actuator rod from said control device when said button is released.

12. The pivoting handle and control arrangement for a floor care appliance of claim 8, wherein said control device is a switch.

13. The pivoting handle and control arrangement for a floor care appliance of claim 12, wherein one of said features is a suction-motor and said switch when engaged surges the suction-motor by applying full power to said suction-motor.

14. The pivoting handle and control arrangement for a floor care appliance of claim 13, wherein said switch is part of a control circuit for controlling said one or more features including said suction motor.

15. A pivoting handle and control arrangement for a vacuum cleaner, a pivoting handle having an upper section and a lower section;

an actuator rod passing through the upper section having a button at one end; and a switch located in the lower section which is pushed by said actuator rod when said button is pressed.

* * * * *